United States Patent [19]

Wells

[11] Patent Number: 4,545,857

[45] Date of Patent: Oct. 8, 1985

[54] LOUVERED STEAM BOX FOR CONTROLLING MOISTURE PROFILE OF A FIBROUS WEB

[75] Inventor: Roger Wells, Mercer Island, Wash.

[73] Assignee: Weyerhaeuser Company, Tacoma, Wash.

[21] Appl. No.: 571,321

[22] Filed: Jan. 16, 1984

[51] Int. Cl.[4] ..... D21F 1/80; D21F 5/00; F26B 13/02; F26B 21/12

[52] U.S. Cl. ..... 162/252; 34/48; 34/54; 162/290; 162/359

[58] Field of Search ..... 162/290, 252, 198, 207, 162/DIG. 6, 259, 375, 359; 34/34, 54, 48

[56] References Cited

U.S. PATENT DOCUMENTS

| | | | |
|---|---|---|---|
| 3,416,237 | 12/1968 | Sutherland et al. | 34/54 |
| 3,516,607 | 6/1970 | Shelor | 239/13 |
| 3,711,957 | 1/1973 | Carver, Jr. | 34/34 |
| 3,726,757 | 4/1973 | Dupasquier | 162/290 |
| 3,795,578 | 3/1974 | Dupasqyuer | 162/290 |
| 3,945,570 | 3/1976 | Dove | 239/135 |
| 4,249,992 | 2/1981 | Wells | 162/198 |
| 4,253,247 | 3/1981 | Bergstrom | 34/34 |
| 4,312,139 | 1/1982 | Preisler et al. | 34/54 |
| 4,330,947 | 5/1982 | Throp | 162/252 |
| 4,331,510 | 5/1982 | Wells | 162/252 |
| 4,351,700 | 9/1982 | Dove | 162/359 |

OTHER PUBLICATIONS

"Profile Analysis for Evaluation of a Compartmentized Steam Box", by Chari et al., TAPPI Annual Meeting Preprint, (Mar. 15, 1976).

*Primary Examiner*—Steve Alvo

[57] ABSTRACT

A steam box or hood for controlling the moisture profile of a fibrous web such as paper during forming and pressing is described. The steam hood includes a plenum filled with nonturbulent, substantially atmospheric pressure steam which delivers the steam into a series of side-by-side compartments which extend across the width of and adjacent to the web. Each compartment includes a damper, the position of which is individually controllable through a rod adjustment from the operating side of the machine. The position of the damper determines the amount of steam applied to the web from a compartment and hence the moisture content of the web adjacent to the particular compartment being adjusted. Each compartment is adjusted to achieve a desired uniform moisture content across the width of the web.

11 Claims, 9 Drawing Figures

LOUVERED STEAM BOX FOR CONTROLLING MOISTURE PROFILE OF A FIBROUS WEB

BACKGROUND OF THE INVENTION

1. Field of the Invention

The invention relates principally to improving dewatering of a fibrous web by applying steam to the web, typically just as it passes over a vacuum box. In particular, the invention relates to a method and apparatus capable of adjusting the moisture content of a paper web on a paper machine in the cross machine direction to achieve a uniform moisture profile.

2. Review of the Prior Art

It is well known in the art of papermaking to employ steam showers or boxes to improve suction dewatering of pulp and paper webs at various locations on the paper machine. Such showers are especially useful at the "wet end" or forming sections of the paper machine where the web typically exceeds 50 percent moisture content by weight. They are also useful in improving press section dewatering.

A typical steam box impinges dry, saturated or superheated, steam onto the traveling web. The web, supported on a forming wire or drying felt, is simultaneously subjected to a vacuum. The vacuum pulls the steam into the sheet interior where it condenses, giving up its heat of condensation to the water content of the web. The increase in temperature dramatically lowers the viscosity and surface tension of the water content of the web, resulting in a more thorough extraction of water for a given vacuum.

The use of a steam hood generally decreases the overall moisture level of the web, across its entire width. It is the experience of papermakers, however, that significant non-uniformity of moisture content across the width of the web may occur which adversely affects paper machine operation. For example, on a typical machine, the outer edges of the web may be at three percent moisture in comparison with a seven percent moisture content at the center of the web.

It is further the experience of papermakers that various defects in machiney or in its operation in the forming section of a paper machine result in "wet streaks" or areas that have relatively high moisture content with respect to surrounding web areas. Wet streaks may also originate in the press machine section when portions of the press felts become plugged because of faulty felt cleaning shower systems. These streaks appear at unpredictable locations across the width of the web. Wet streaks can run for days before the source of difficulty is found.

The moisture profile uniformity of the web as it leaves the forming section determines to a large extent uniformity in finished paper at the reel. This is so because conventional pressing and can drying are not usually designed to correct local web nonuniformity across the paper machine width.

The speed of the entire machine may be determined by a wet streak, even if only two inches wide. Compensation for one or two regions of wet streaking will often necessitate a reduction in overall water content of the web by several percent in order to build an acceptable reel. These effects on machine speed and steam consumption thus have an important impact on the profitability of the papermaking operation.

The prior art describes a number of schemes for attempting to control the sheet moisture profile in the cross machine direction. Compartmentalized steam hoods, for example, shower a wet streak with extra steam in an effort to reduce overall variability and the potential for rejection at the reel for failure to meet maximum water content specifications.

Dupasquier, in the U.S. Pat. Nos. 3,726,757 and 3,795,578, describes a steam shower divided into 11 compartments across the width of the paper machine, each equipped with a separate steam flow valve. A vacuum box, opposite the shower and under the machine wire, draws steam into the web across the entire width of the machine. Chari et al. "Profile Analysis for Evaluation of a Compartmentalized Steam Box," TAPPI Annual Meeting Preprint (Mar. 15, 1976) describes operation of the Dupasquier hood. The object of the hood is to improve the basis weight and moisture profile by indiviudally controlling steam flow to each compartment. The Chari experiment shows that the profiling steam hood is effective in reducing long-term, cross machine moisture profile variation. The Dupasquier hood resulted in a total reduction of variance of moisture content of approximately 40 percent from a base line value without any significant change in bone dry fiber profiles.

Shelor, U.S. Pat. No. 3,516,607 and Dove, U.S. Pat. No. 3,945,570 also show compartmented steam boxes. In Dove, a portion of the steam is applied across the entire width of the web and another portion of steam is sent through compartmented sections over the web. Shelor is an example of many methods which control the flow of steam into each steam box or compartments by means of a flow control valve.

There are a number of problems with valve-controlled systems. Since typical boxes extend across the width of the web, which may be from 80 to 390 inches, as many as 65 valves may be used. This requires bulky structural systems suspended over the web to support the weight of the heavy valves of the box. Conventional hardware is heat sensitive and thus subject to excessive maintenance problems. Air controlled valves require plastic diaphragms which are so heat sensitive that desuperheated steam must be used. These valves also require pressure regulators, gauges and long control lines, all of which add to the complexity and unreliability of the resulting system.

A principal problem, however, is that the separately valved compartmented boxes lack precision in control. The amount of steam passing through the valve is often unknown and must be determined by means other than merely adjusting the valve control means.

In Wells, U.S. Pat. No. 4,249,992, a method and apparatus was disclosed which avoids a number of valving difficulties by varying the steam discharge opening of each compartment to the web, thus regulating the amount of steam absorbed by the web. These hoods are useful, but require rather complex, unique internal structures which are somewhat bulky and thus unsuitable for use in some mill locations.

SUMMARY OF THE INVENTION

It is an object of the invention herein to provide a steam shower or box which avoids the valving problems of the prior art and is capable of producing a uniform moisture profile across the width of a fibrous sheet.

It is further an object of the invention to provide a simplified control scheme suitable for modifying existing plenum-type steam hoods or boxes and for use in other mill applications such as in press sections where installation spaces are narrow.

The apparatus of the invention is generally used where it is an advantage to apply steam to a fibrous web traveling continuously through a process involving dewatering such as, for example, in forming, pressing, or otherwise treating a paper web. The apparatus includes a plenum extending across the width of the web for delivering substantially non-turbulent constant pressure steam adjacent to the web. A louver or steam outlet control means receives the steam from the plenum and delivers it onto the web. The amount of steam received by the web varies across its width, depending upon its local moisture content. The louver control means includes a plurality of side-by-side compartments across the width of the machine, each extending from the plenum close to the traveling web. Each compartment includes a damper capable of regulating the flow of steam from the plenum onto the adjacent web. The damper is adjusted to achieve the desired impact on the web at the particular point of application.

The machine operator is usually seeking to achieve a uniform moisture profile across the width of the web. The operator first observes or senses the average moisture content of the web adjacent the discharge of each hood compartment. The operator then adjusts the damper means for each compartment to achieve the overall uniform profile. After some time he re-observes the condition of the web and readjusts the damper means as necessary.

The damper is much like a butterfly valve, including a damper blade which, depending upon its position, controls flow through the compartment between no flow and a maximum. The damper blade is fixed to an axial means pivotally mounted in the compartment walls such that the damper blade is free to rotate about its axis. A control rod is attached either to the damper blade or the axial means and extends to an operating side of the paper machine for adjustment by the machine operator.

A number of means may be used to control the damper position such as pneumatic operators, gears and the like. Typically, a spring means positions the damper in a closed position until there is positive control action causing it to open.

The profiling apparatus of the invention is particularly useful in adjusting the moisture profile of a paper web on a forming wire. Its relatively small dimensions and compact shape are such that it is also useful in controlling the moisture profile of a paper web in the press section of a paper machine. In neither case will steam flow from the box disrupt the paper sheet itself.

BRIEF DESCRIPTION OF THE DRAWINGS OF THE PREFERRED EMBODIMENTS

DETAILED DESCRIPTION OF THE PREFERRED EMBODIMENTS

Figure 1:
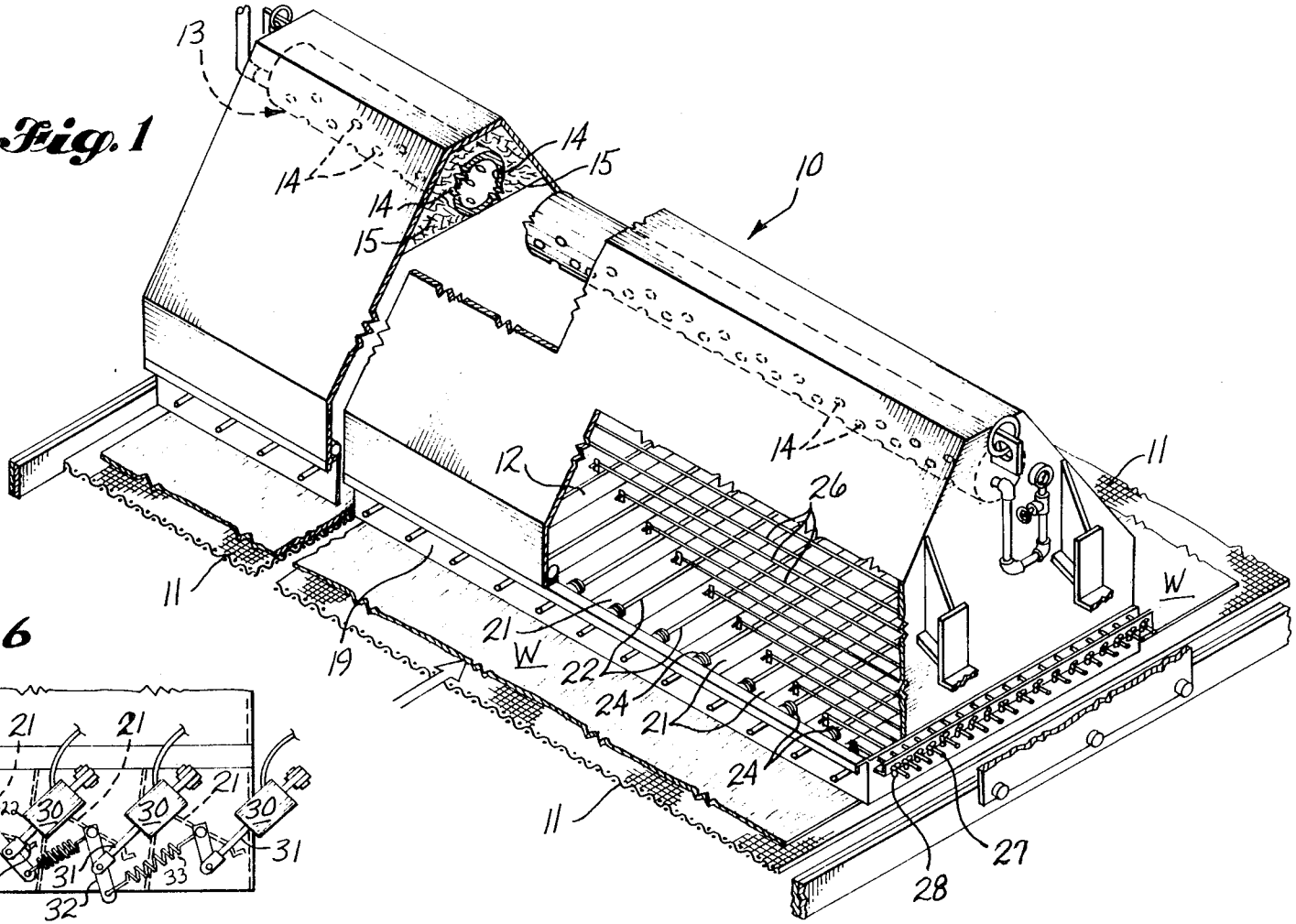
FIG. 1 is an oblique view of a steam hood of the invention supplying steam to the forming section of a paper machine.
Figure 2:
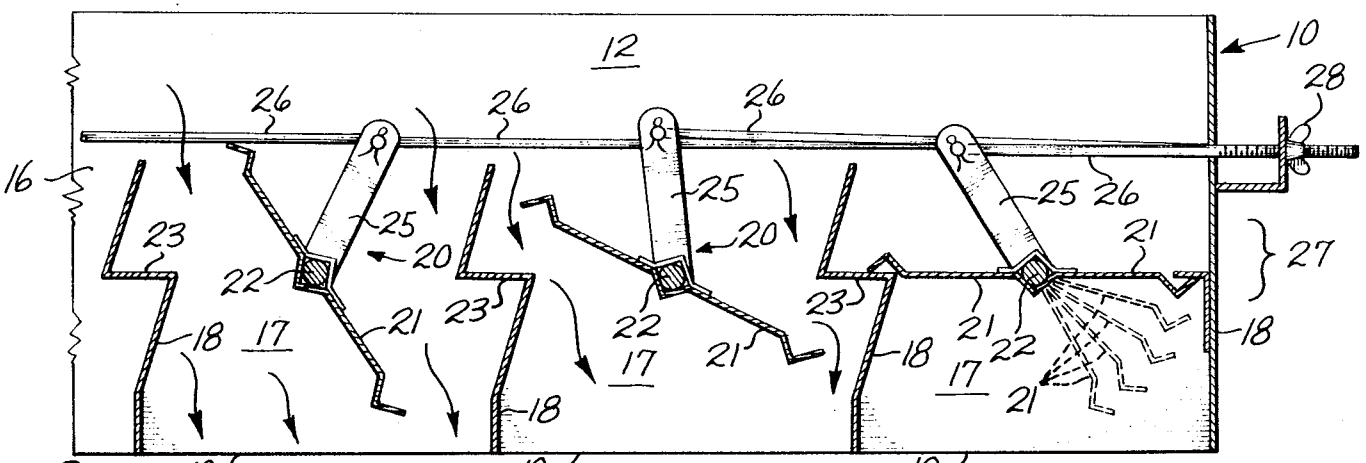
FIG. 2 is a sectional end view of a portion of the louver-control system.
Figure 3:
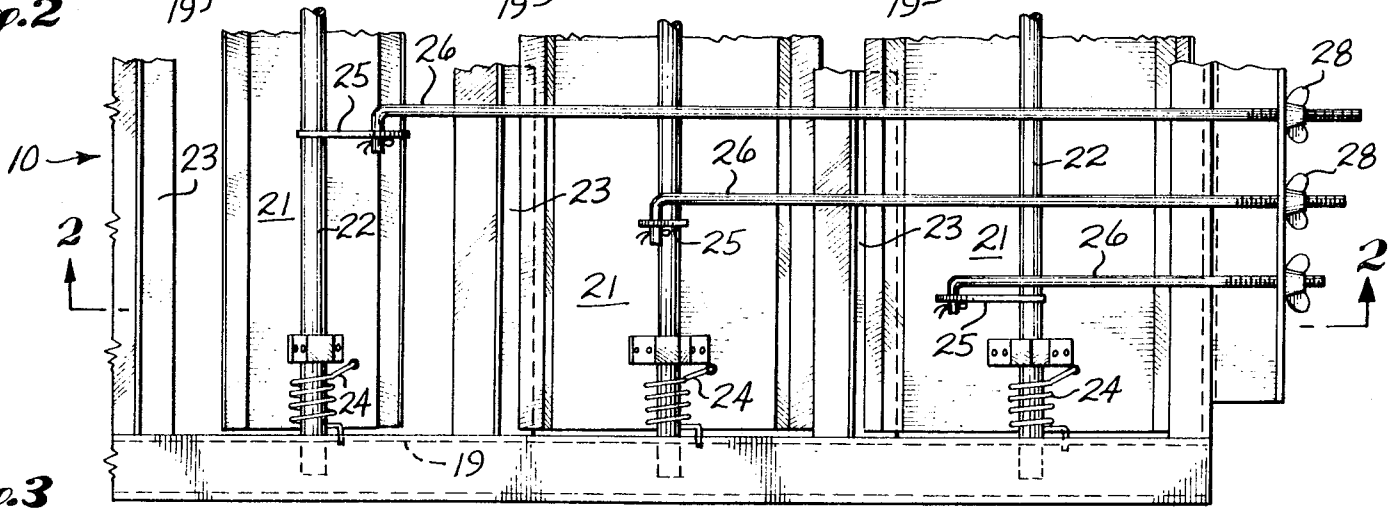
FIG. 3 is a detailed plan view of a portion of the damper control means.

Referring to FIGS. 1–3, the preferred louvered moisture profiling steam box apparatus 10 of the invention is shown applying varying quantities of steam to a cellulosic web W transported on forming wire 11 across a vacuum box (not shown) under the wire. A plenum 12 is filled with substantially non-turbulent superheated steam flowing from an apertured steam pipe 13 extending across the width of the paper machine. The apertures 14 of the pipe 13 are sized to produce "choked flow" conditions, resulting in uniform flows of steam into the plenum 12 regardless of minor steam pressure variations locally along the distributor pipe 13. The velocity of the steam discharging from the orifices is dissipated by expanding into a triangular shaped plenum through a stainless steel wool packing 15 surrounding the pipe discharge orifices 14. The resulting non-turbulent steam completely fills the steam hood plenum at substantially atmospheric pressure.

The plenum discharges its steam into a louver control means 16 as shown in FIG. 2. The louver control means 16 includes a series of adjacent compartments 17 which, side-by-side, extend across the width of the paper machine. As typical of many compartmented hoods, the width of the compartments is usually selected to duplicate forming slice widths of about 6 inches. The length of each compartment, in the machine direction, is selected so that in conjunction with width, enough steam can be delivered to the web to achieve the dewatering impact desired. A typical dimension is 36 to 60 inches. The walls 18, 19 of each compartment extend from the plenum adjacent to, as close as practicable, the traveling web. Clearances on the order of 0.5–1.0 inches is typical.

Each compartment 17 includes a damper 20 for controlling the amount of steam discharged from the plenum onto the web. The damper is a blade 21 having a shape and cross sectional area to substantially close off the compartment to the plenum when in a substantially horizontal position. The blade 21 is fixed to an axial rod 22 which is mounted in compartment cross machine side walls 19. The mounting is such that the axial rod is free to rotate, thus rotating the damper blade 21 position. sidewall stops 23 limit rotation of the blade as it reaches the horizontal or closed position where steam flow is closed off. The blade 21 is biased closed against the stops 23 by a spring 24.

A control rod system allows the operator at an operating side of the paper machine to position the damper in each compartment. The control rod system includes a lever arm 25 attached to each damper blade 21. A control rod 26 is pivotally fixed to the lever arm 25, exiting at right angles to the blade 21, to an operating side 27 of the steam box. The rod 26 terminates on the operating side with a threaded portion. A wing nut 28 threads onto the rod to secure the damper plate 21 in position, after it is set, against the tension of the biasing spring 24. The control rods 26 are spaced along the blades 21 in the machine direction so that there is no interference between compartments.

In operation, steam in the plenum 12 flows into the control compartments 17 that are open. Steam, in an amount in direct proportion to the discharge area opening, determined by the position of the louver blade 21, passes through into contact with the web. Where the open cross sectional area is reduced, the steam moves laterally through the plenum to a compartment which is more open. There are sufficient numbers of dampers such that the opening or closing of them does not significantly affect the hood plenum steam pressure.

Figure 4:
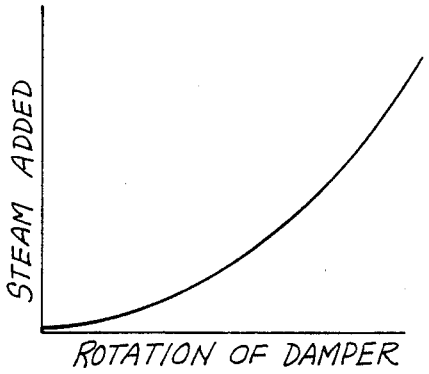
FIG. 4 is a graph showing steam added as a function of damper blade position.
Figure 5:
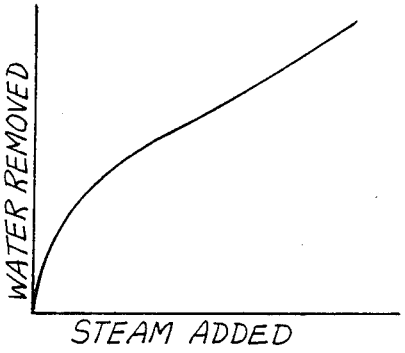
FIG. 5 shows water removal as a function of steam added.

In the embodiment shown in FIG. 2, the width of the damper blade 21 is selected so that the blade is within about ⅛ inch of the sidewalls. As the damper blade 21 is rotated by the control rod means, the discharge opening increases as the blade moves away from the wall surface 18. The opening increases sinusoidally with the degree of rotation. The result, as shown in FIG. 4, is that, since steam flow is directly proportional to the cross sectional area of the opening, the flow or "steam added" to the web increases very gradually as the damper blade 21 begins to open. This is advantageous because, as shown in FIG. 5, the impact of steam on the WEB, i.e., "water removed" is greatest for the first amounts of steam used.

The overall impact of the steam hood on the web may be adjusted by changing the steam pressure input to the plenum once the cross machine profile is established. The steam input to the plenum can be varied to maintain a desired moisture level at the reel.

With respect to width of the compartment discharge opening, the opening increases as the cosine of the angle of rotation of the damper increases. It is an advantage to carefully regulate the first few pounds added to the web since this steam has the most dramatic impact on dewatering. Thus, it appears desirable in most cases to cause the damper to open very slowly initially. On the other hand, operators likely would prefer a more linear relationship between rod adjustment and water removal. As shown in FIG. 2, the angles of the sidewalls may be adjusted to achieve a more linear relationship between the effect on sheet drainage and damper position, if desired. Experimental data show that the last 10 percent opening of the damper has a much greater effect than the last 10 percent opening of typical steam control valves used in prior art compartmented hoods.

Figure 6:
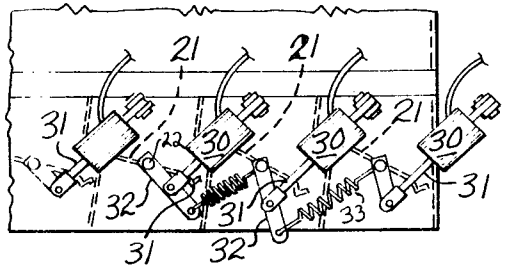
FIG. 6 shows the use of pneumatic controls to regulate damper positions.

There are many modifications to the basic louver control system described above which will be apparent to those skilled in the art. FIG. 6, for example, shows controlling damper positions using air cylinders 30. The cylinder piston rod 31 advances, in response to a control action, to cause lever arm 32, fixed to axial shaft 22, to rotate the damper blade 21. A spring 33 biases the damper 21 in the closed position. Use of air cylinders are useful for remote control arrangements.

Figure 7:
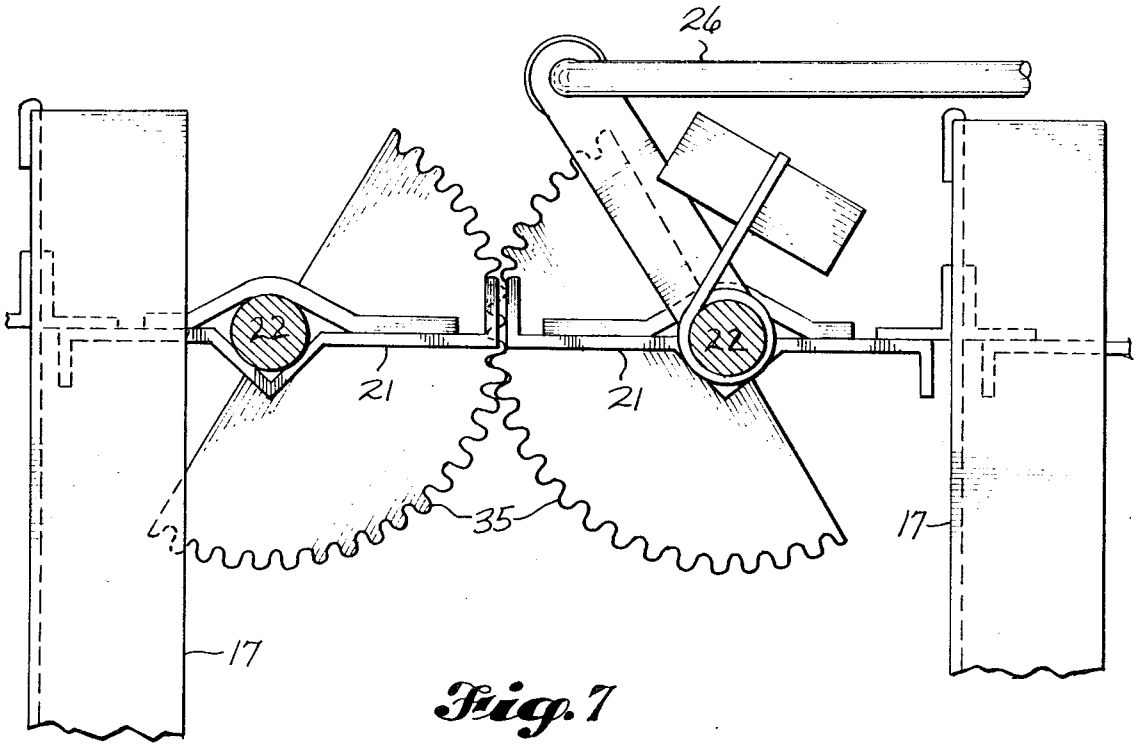
FIG. 7 shows a double-damper blade control system.

FIG. 7 shows a variation in damper configuration in which each compartment 17 is supplied with two damper blades 21. A gear pair 35 mounted on the damper axial shafts 22 intermesh such that movement of control rod 26 causes both dampers to change position. The gears 35 are actually made by cutting a single gear in half and fixing them to the damper axial rod ends 22 to operate the dampers 21 through a 90° rotation. The double damper system in some cases helps uniformly distribute the steam onto the web. A small electric gear motor (not shown) may be fitted to one gear to provide remote electric operation.

As another variation in damper control configuration, a single blade could be pivoted at or close to one edge of the blade. This arrangement is useful in achieving a linear steam effect.

Figure 8:
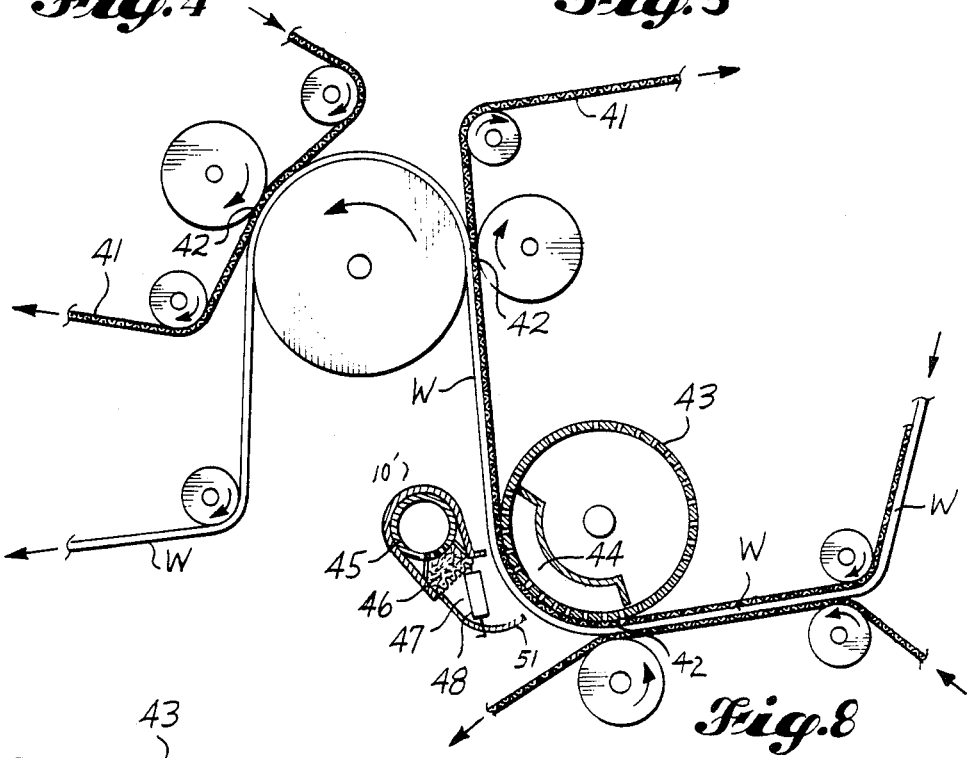
FIG. 8 is a schematic showing an apparatus of the invention utilized in a press section of a paper machine.
Figure 9:
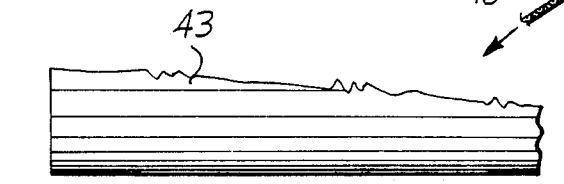
FIG. 9 is a plan view of the press section apparatus louver control means.
Figure 9:
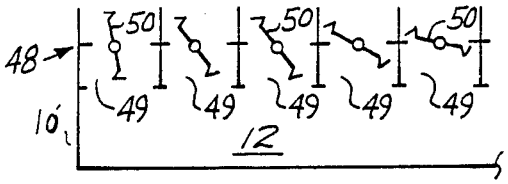

FIGS. 8 and 9 show a louvered steam hood 10' apparatus of the invention employed in a paper machine press section. The paper web W travels supported on felts 41 through a number of dewatering press nips 42. The press roll 43 includes a suction gland 44 across which the felt-supported web W passes. The louvered steam box 10' is urged adjacent the web to improve web moisture profile by application of steam to the web exactly as described above with respect to the paper machine forming section shown in FIGS. 1–3. FIG. 8 shows apertured steam pipe distributor 45 discharging steam under choked flow conditions through steel wool packing 46 into plenum 47.

As shown in FIG. 9, louver control means 48 includes compartments 49 across the width of the web and the louver blades 50. The discharge compartment walls 51 may be contoured somewhat to better direct the steam into contact with the web.

The steam hood works best where the plenum is located above the zone of steam discharge to the sheet. In this position, the non-turbulent substantially zero velocity steam tends to float and disperse throughout the plenum rather than flow into any particular compartment. If the plenum were underdeath the compartments, steam would rise and try to escape out the closest opening. If the steam were introduced at one end of the box, it would tend to flow out the first available opening. The tendency of steam to rise and flow sideways rather than downwards distributes the steam evenly throughout the plenum without depending upon a substantial pressure differential. The plenum must be large enough so that it always remains at an insignificant pressure, i.e., 1/20 of an inch of water, whether the louvers are open or closed. The damper clearances between the damper blade and the compartment walls are enough so that even if all the dampers are closed, there is enough leakage so that pressure in the plenum never exceeds 1 psig. No safety valves or vents are required.

EXAMPLE

A non-compartmented steam hood, comprising substantially the plenum portion of the hood shown in FIG. 1 installed on Weyerhaeuser's NC 2 paper machine, was converted to the louvered profiling steam hood of the invention by adding the louver control means 16 (FIG. 2), described above. The hood plenum was raised about 6 inches and the louver control means was fixed thereunder. A compartment width of 6 inches, equivalent to the paper forming section slice width of about 6 inches, was chosen. The machine direction dimensions of each compartment was 36 inches. There were 28 compartments across the width of the machine. The paper machine speed was 425 feet per minute, running Weyerhaeuser pulp grade "416 Atlantic". The steam distributor 13 of the box was operated at 45 psig.

The following data shows the effectiveness of the hood in controlling wet streaks. The test consisted of choosing a slice position with moderate moisture content with its damper in the middle of its range and adjusting the damper from fully closed to fully open. Slice 9 was selected, showing the following results:

TABLE

EFFECT OF DAMPER POSITION AT SLICE 9 - NC2.

| DAMPER POSITION* | % MOISTURE AT REEL** | COUCH SHEET TEMPERATURE |
|---|---|---|
| 1⅝" (Pre-trial) | 6.1% | 158° |
| 1" | 7.8% | — |
| ½" (Fully Closed) | 8.6% | 121° (Minimum) |
| 1" | 7.1% | 128° (Minimum) |
| 1½" | 6.3% | 132° (Minimum) |
| 2" | 5.7% | 152° (Minimum) |
| 2½" | 5.5% | 160°-170° (Range) |
| 3" | 5.4% | 168°-178° (Range) |
| 3¾" (Fully Open) | 5.1% | 193°-202° (Range) |

*Damper position given in inches of adjustment rod 26.
Average reading over 10 min. period after adjustment closing and opening the slice 9 damper resulted in the moisture contents of the sheet passing beneath the hood adjacent slice 9** varying between 8.6 percent (closed) to 5.1 percent (wide open). In a test similar to the above, a wet streak of 10.5 percent moisture content was reduced to 6.0 percent. There are certain variations of the mechanical elements of the invention that are obvious to those skilled in the art and are included within the scope of this invention. For example, the louver control mechanism may consist of replacing the pull rods with choke cables or the entire linkage may comprise a wire cable operating around pulleys. The push rods themselves could be operated by gear motors positioning the louver according to voltage supplied to the motor.

I claim:

1. A steam hood for use adjacent to a moving moist fibrous web to control the moisture profile across the width of the web which comprises:

a. a steam plenum means of sufficient length to extend across the web;

b. a steam inlet means for the plenum means, said inlet means being adapted to supply substantially non-turbulent steam at essentially atmospheric pressure within the plenum means;

c. a steam outlet control means at the outlet of the plenum means so as to be positionable adjacent to the web at the outlet of the steam hood, said control means structured to deliver varying amounts of steam from the plenum means to the web at different positions across the full width of the web, said plenum means permitting free lateral movement of steam to said different positions, said control means further comprising a plurality of side-by-side adjoining compartments across the width of the control means, each compartment being of essentially rectangular cross section defined by side and end walls, each compartment being in communication with the plenum means;

a damper means located in each compartment, said damper means comprising at least one damper blade affixed to a shaft journaled in the compartment walls and a position control lever affixed to the shaft so that the damper blade is rotatable between a closed and an open position to act as a steam outlet valve for the compartment; and operating rod means associated with each position control lever in order to individually control the position of each damper blade, each operating rod means extending to an operating location on the steam hood wherein each damper means can be individually positioned to deliver an amount of steam to an adjacent portion of the web so as to achieve a more uniform moisture profile across the web.

2. The steam hood of claim 1 in which the axis of each rotatable shaft is positioned substantially parallel to the direction of movement of the fibrous web and is journaled in opposite end walls of a control means compartment.

3. The steam hood of claim 2 in which each damper blade is of essentially the same dimensions as the cross sectional dimensions of the compartment.

4. The steam hood of claim 2 in which each compartment side wall has a stop to limit damper blade rotation and act as a sealing surface to essentially prevent steam flow when the blade is in a closed position.

5. The steam hood of claim 2 in which each compartment side wall is configured to achieve a more linear relationship between steam flow and damper rotation.

6. The steam hood of claim 2 in which each blade is biased in a closed position by a spring means.

7. The steam hood of claim 2 in which the operating rod means extend normal to the axes of the damper blade shafts.

8. The steam hood of claim 7 which further includes pneumatic control means to position the operating rod means.

9. The steam hood of claim 1 further in combination with a paper machine forming wire wherein the hood is employed to adjust the moisture profile of a paper web on the paper machine.

10. The steam hood of claim 1 further in combination with the press section of a paper machine wherein the hood is employed to adjust the moisture profile of a paper web on the paper machine.

11. The steam hood of claim 1 in which each damper means comprises two adjacent damper blades affixed to rotatable shafts whose axes are positioned substantially parallel to the direction of movement of the fibrous web and are journaled in opposing end walls of a control means compartment, said shafts being geared together for simultaneous movement, and a control lever acting between one shaft and the operating rod wherein the operating rod may be moved to control the degree of opening of the damper blades and the amount of steam deliverd to the moving web.

* * * * *